US011288907B1

(12) United States Patent
Hsieh et al.

(10) Patent No.: US 11,288,907 B1
(45) Date of Patent: Mar. 29, 2022

(54) SMART ELECTRONIC LOCK AND THE METHOD FOR USING SAME

(71) Applicant: YAIS CO., LTD., New Taipei (TW)

(72) Inventors: Chih-Kai Hsieh, New Taipei (TW); Chang-Jung Su, New Taipei (TW); Chia-Wei Chang, New Taipei (TW)

( * ) Notice: Subject to any disclaimer, the term of this patent is extended or adjusted under 35 U.S.C. 154(b) by 0 days.

(21) Appl. No.: 17/220,054

(22) Filed: Apr. 1, 2021

(51) Int. Cl.
*G07C 9/33* (2020.01)
*G07C 9/27* (2020.01)
*G07C 9/00* (2020.01)

(52) U.S. Cl.
CPC ..... *G07C 9/33* (2020.01); *G07C 9/00309* (2013.01); *G07C 9/27* (2020.01); *G07C 2009/00634* (2013.01); *G07C 2209/08* (2013.01)

(58) Field of Classification Search
CPC ..... G07C 9/33; G07C 9/27; G07C 9/00309; G07C 2009/00634; G07C 2209/08; G07C 9/21
See application file for complete search history.

(56) References Cited

U.S. PATENT DOCUMENTS 7,009,489 B2 * 3/2006 Fisher ..... G07C 9/21 340/5.7
8,339,239 B2 * 12/2012 Kirkjan ..... G07C 9/00309
8,922,333 B1 * 12/2014 Kirkjan ..... G07C 9/00309 340/5.1
9,728,017 B2 * 8/2017 Paquin ..... G07C 9/00174
10,360,746 B1 * 7/2019 Giles ..... G08B 25/008
10,487,541 B1 * 11/2019 Zhang ..... E05B 37/12
2003/0160681 A1 * 8/2003 Menard ..... G07C 9/00309 340/5.64
2003/0231102 A1 * 12/2003 Fisher ..... G07C 9/27 340/5.73
2003/0231103 A1 * 12/2003 Fisher ..... G07C 9/00896 340/5.73
2009/0085717 A1 * 4/2009 Kirkjan ..... G07C 9/00309 340/5.2
2011/0087370 A1 * 4/2011 Denison ..... G07C 9/21 700/236
2012/0280790 A1 * 11/2012 Gerhardt ..... G07C 9/00571 340/5.61
2014/0049365 A1 * 2/2014 Ahearn ..... G07C 9/00182 340/5.51
2014/0068247 A1 * 3/2014 Davis ..... H04L 9/3228 713/155
2014/0091905 A1 * 4/2014 Wang ..... G05B 1/01 340/5.54

(Continued)

*Primary Examiner* — Brian E Miller

(57) ABSTRACT

Provided is a smart electronic lock and method for using same. The smart electronic lock includes an electronic lock body having a USB socket internally connected to a main control board for driving a driver to connect to an electronic lock cylinder, and a handheld device having a main power source and an unlocking unit for allowing user to input an unlocking password through an unlocking application, as well as a USB connection cable that is removably connected between the handheld device and the electronic lock body. The smart electronic lock eliminates the need of configuring an internal power source or a battery and allows the handheld device to supply power to the main control board through a USB charging port. The unlocking of the electronic lock body is attained by the comparison result of an inputted unlocking password.

3 Claims, 8 Drawing Sheets

(56) References Cited

U.S. PATENT DOCUMENTS

| | | | | |
|---|---|---|---|---|
| 2015/0015362 | A1* | 1/2015 | Murphy | G07C 9/30 340/5.3 |
| 2016/0055694 | A1* | 2/2016 | Saeedi | G07C 9/27 340/5.52 |
| 2016/0180621 | A1* | 6/2016 | Desinor, Jr. | G07C 9/00896 340/5.61 |
| 2016/0294837 | A1* | 10/2016 | Turgeman | G06F 3/04886 |
| 2016/0350988 | A1* | 12/2016 | Malhotra | H04W 12/08 |
| 2017/0161978 | A1* | 6/2017 | Wishne | G07C 9/21 |
| 2017/0191287 | A1* | 7/2017 | Mittleman | H02J 7/025 |
| 2018/0190056 | A1* | 7/2018 | Desinor, Jr. | E05B 19/0005 |
| 2018/0247473 | A1* | 8/2018 | Panchai | G07C 9/00857 |
| 2020/0043271 | A1* | 2/2020 | Anderson | F21V 33/006 |
| 2020/0055394 | A1* | 2/2020 | Chen | B60R 25/23 |
| 2020/0250908 | A1* | 8/2020 | Shah | G07C 9/38 |
| 2021/0279985 | A1* | 9/2021 | Igein | G07C 9/23 |

* cited by examiner

SMART ELECTRONIC LOCK AND THE METHOD FOR USING SAME

FIELD OF THE DISCLOSURE

The invention is related to an electronic lock, and more particularly to a smart electronic lock and the method for using same.

BACKGROUND OF THE INVENTION

Locks are necessities for security. Locks are known to be able to prevent others from trespassing on your property. In the past, mechanical locks are required to be picked with keys and are easy to be destroyed and duplicated. Thus, mechanical locks offer a low-level burglarproof capability. More disadvantageously, the key of mechanical locks is fragile and may get rusty or lost, which would cause bother.

With the progress of economy, people need to carry a large number of keys to get access to different doors or gates. This would cause inconvenience and trouble in finding the right key to access. Moreover, carrying a large number of keys that are chained together may cause problems in access control.

The contemporary electronic locks are known to be able to be unlocked without a real key. The electronic locks can be categorized into keycard locks, combination locks, and fingerprint locks. Still, these electronic locks suffer the drawbacks of bulky size, complicated structure, high sale price, and the requirement of a built-in battery.

SUMMARY

To remove the drawbacks encountered by the prior art, the invention is proposed to provide a smart electronic lock, which includes an electronic lock body, a handheld device, and a USB connection cable.

The electronic lock includes an unlocking portion having a USB socket that is internally connected to a main control board for supplying power from an external power source. The main control board includes a microcomputer, a password comparing unit, and a driver that is electrically connected to an electronic lock cylinder. If the comparison result of the password comparing unit is correct, the electronic lock cylinder starts operating for unlocking the electronic lock body.

The handheld device includes a main power source and an unlocking unit. The unlocking unit is provided with a password input area for receiving an input of an unlocking password.

The USB connection cable is removably connected between the handheld device and the electronic lock body, and is used to supply power from the main power source of the handheld device to the main control board of the electronic lock body and transfer the password inputted to the handheld device to the electronic lock body for comparison. If the comparison result of the password comparing unit is correct, the electronic lock cylinder starts operating for unlocking the electronic lock body.

Preferably, the handheld device is a smartphone or a tablet computer, and the unlocking unit may be accomplished by an unlocking application.

Preferably, the electronic lock body 10 can be used independently or combined with a traditional lock. The traditional lock may be a mechanical doorknob lock, a mechanical handle lock, a mechanical mortise lock, a mechanical password lock, an electronic password lock, an electronic fingerprint lock, or an electronic door lock.

Compared to the prior art, the invention removes the need of mounting a built-in battery in the electronic lock body and allows a handheld device to charge the electronic lock body and an unlocking application to unlock the electronic lock body.

DETAILED DESCRIPTION OF PREFERRED EMBODIMENTS

Figure 1:
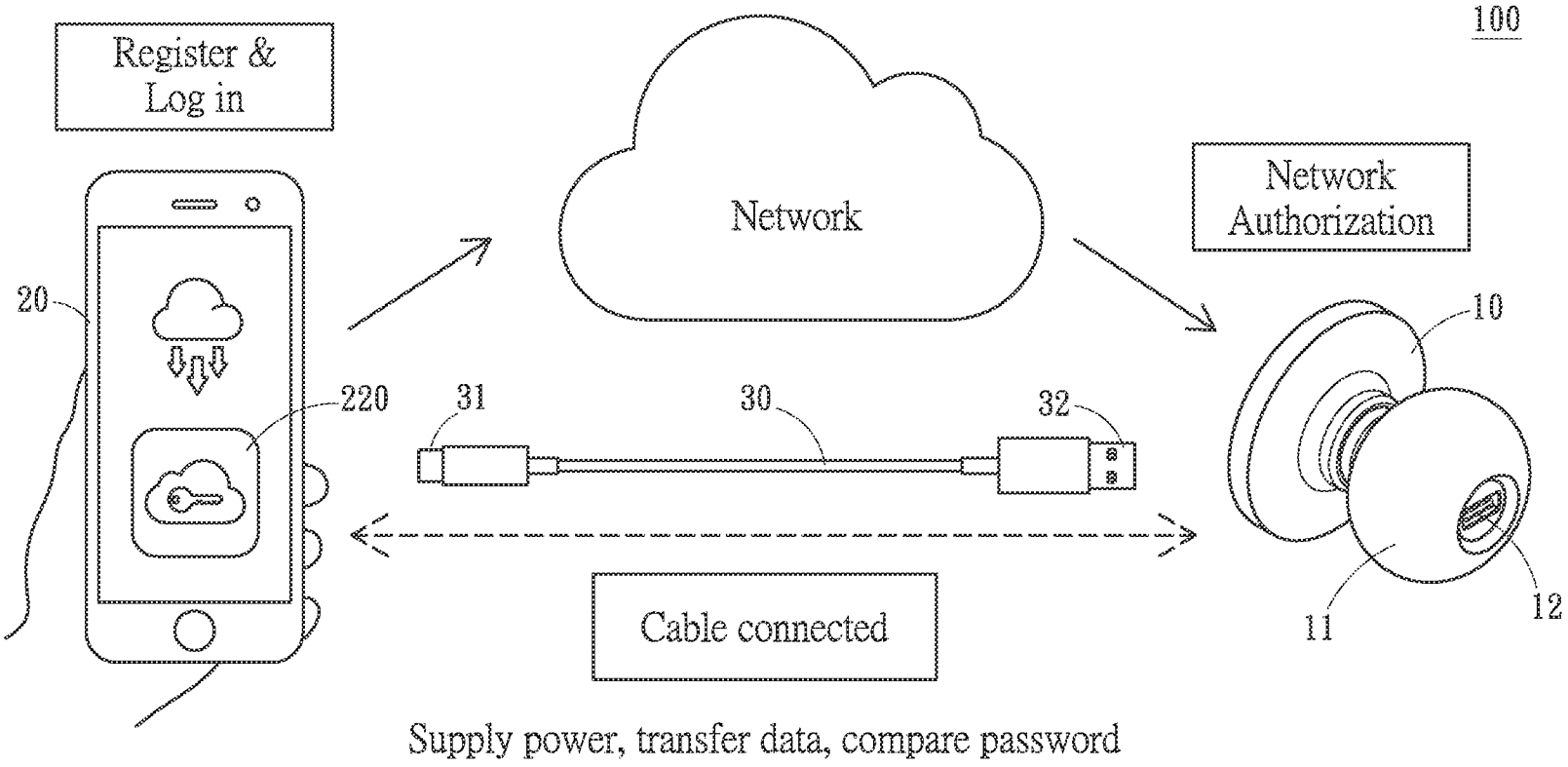
FIG. 1 is a schematic diagram showing the configuration of a smart electronic lock according to the invention.
Figure 2:
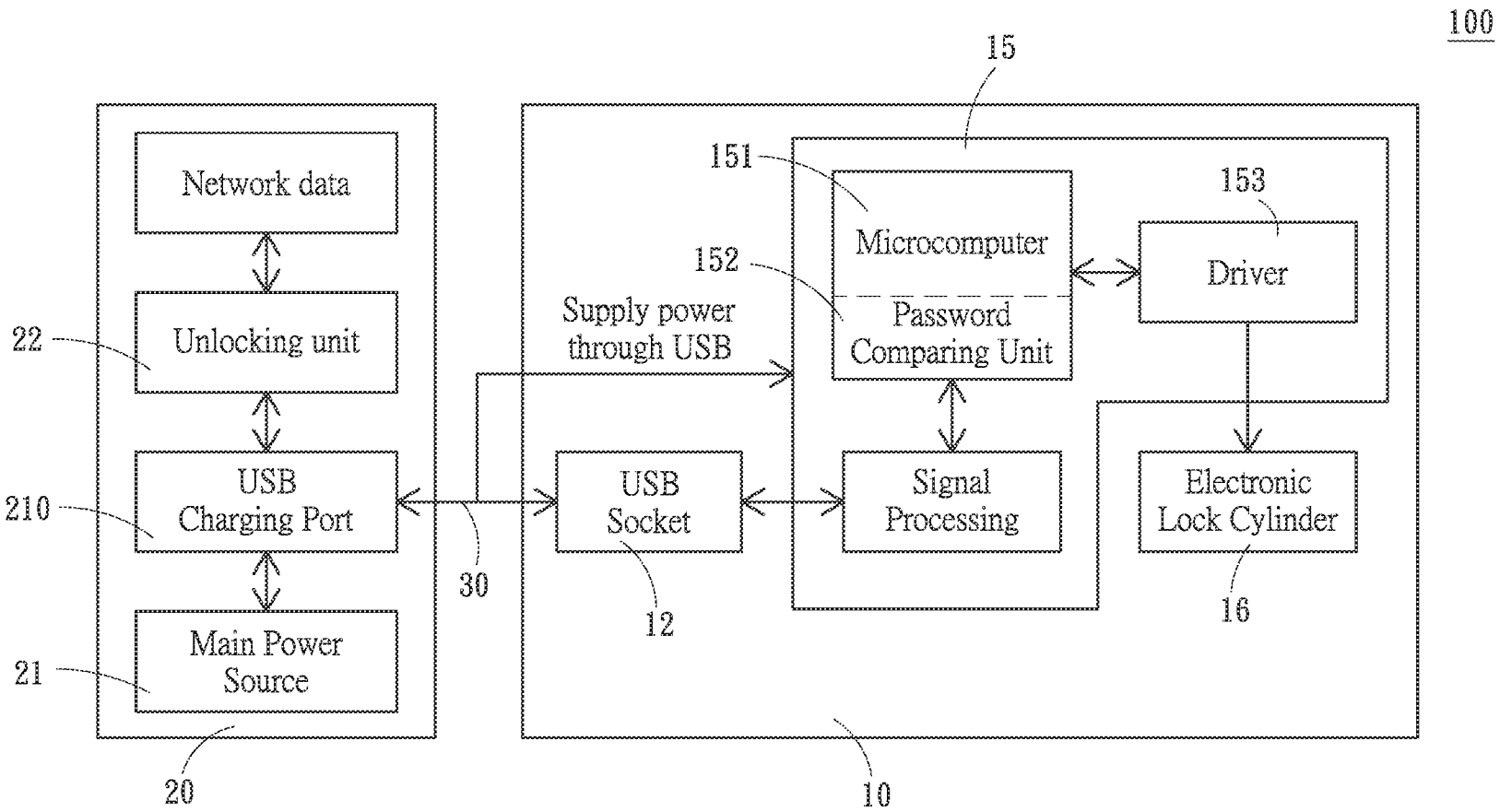
FIG. 2 is a block diagram showing the system of a smart electronic lock according to the invention.
Figure 3:
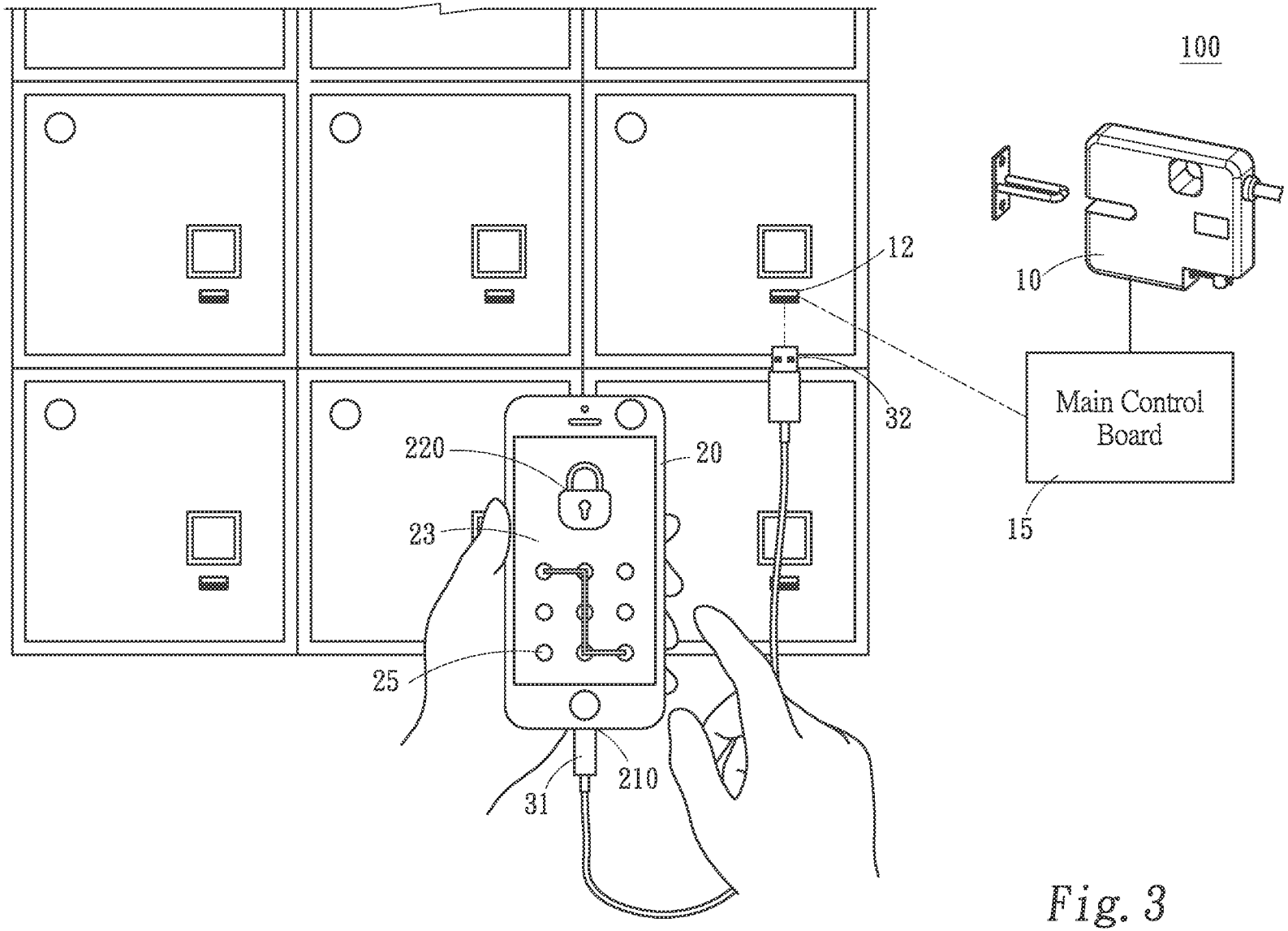
FIG. 3 is a schematic diagram showing the operation of a smart electronic lock according to the invention.
Figure 4D:
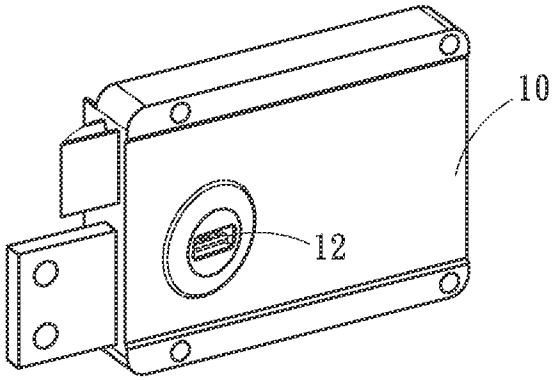
FIGS. 4A-4E are schematic diagrams showing the combination of the electronic lock body of the invention with traditional locks.
Figure 4E:
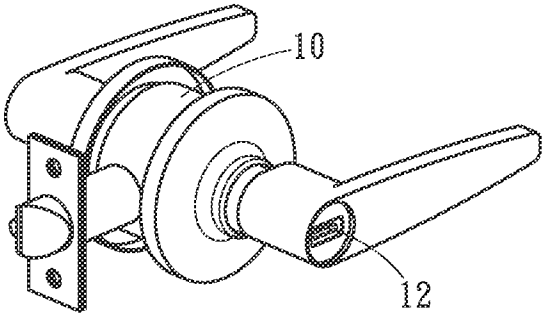
Figure 4B:
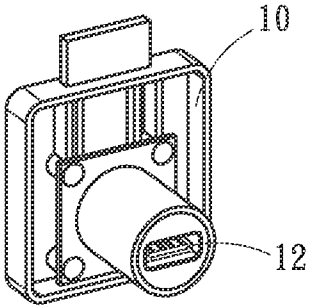
Figure 4C:
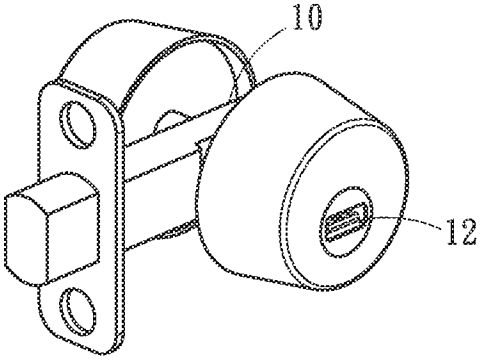
Figure 4A:
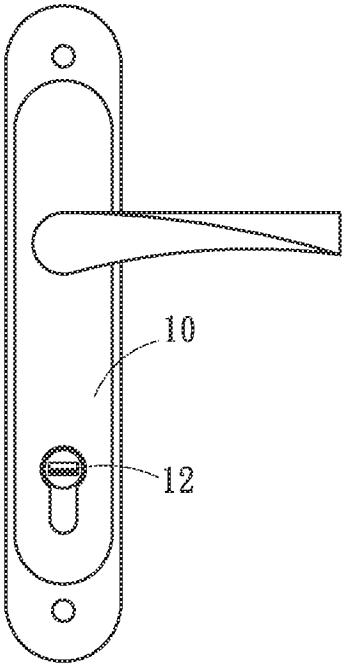

Next, a preferred embodiment of the invention is illustrated with reference to accompanying drawings to give details to the principle and efficacy of the invention. Please refer to FIGS. 1-5. The invention provides a smart electronic lock 100, which includes an electronic lock body 10, a handheld device 20, and a USB connection cable 30.

The electronic lock body 10 includes an unlocking portion 11, which is provided with a USB socket 12. The USB socket 12 is internally connected to a main control board 15, which is powered by an external power source. The main control board 15 includes a microcomputer 151, a password comparing unit 152, and a driver 153 that is electrically connected to an electronic lock cylinder 16. If the comparison result of the password comparing unit 152 is correct, the electronic lock cylinder 16 starts operating for unlocking the electronic lock body 10.

The handheld device 20 includes a main power source 21 and an unlocking unit 22. The unlocking unit 22 includes a password input area 23 for receiving an input of an unlocking password 25.

The USB connection cable 30 is removably connected between the handheld device 20 and the electronic lock body 10 for supplying power from the main power source 21 of the handheld device 20 to the main control board 15 of the electronic lock body 10 and transferring the unlocking password 25 inputted to the handheld device 20 to the electronic lock body 10 for comparison. If the comparison result is correct, the electronic lock cylinder 16 starts operating for unlocking the electronic lock body 10.

Preferably, the electronic lock body 10 can be unlocked by way of network authorization, thereby enhancing the versatility of the smart electronic lock.

As shown in FIGS. 4A-4E, preferably the electronic lock body 10 can be used independently or combined with a traditional lock. The traditional lock discussed herein may be a mechanical doorknob lock, a mechanical handle lock, a mechanical mortise lock, a mechanical password lock, an electronic password lock, an electronic fingerprint lock, or an electronic door lock.

Figure 5:
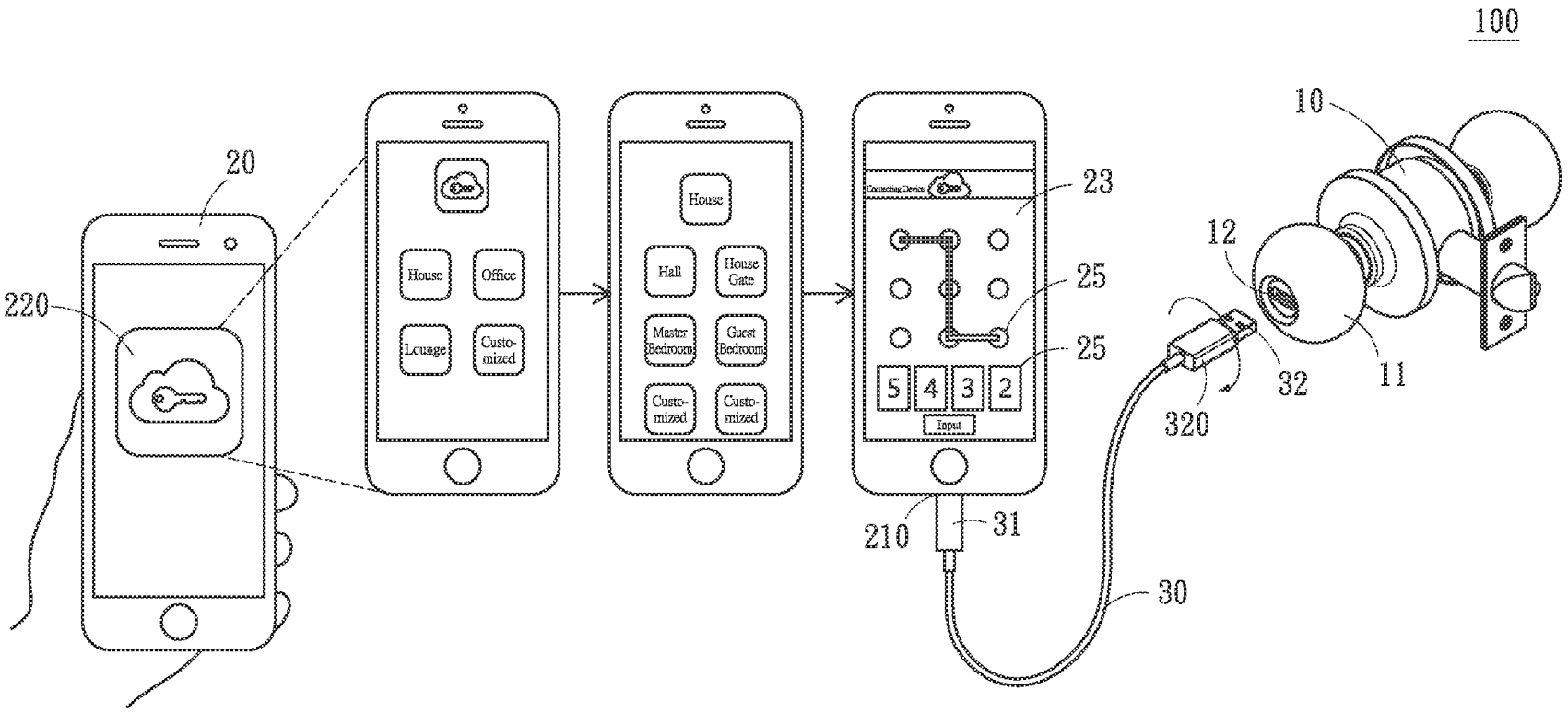
FIG. 5 is a schematic diagram showing the unlocking application of a handheld device according to the invention.

As shown in FIG. 5, preferably the handheld device may be a smartphone or a table computer (not shown). The unlocking unit 22 may be accomplished by an unlocking application (unlocking app) 220. The unlocking app 220 may be used to unlock electronic locks located at different areas of a premise such as a house, a lounge, an office, or a customized building.

Preferably, the unlocking password 25 inputted through the password input area 23 to unlock the electronic lock body may be a four-to-eight-digit number, or a sequence of numbers connecting in a line in a 3-by-3 grid.

Preferably, the USB connection cable 30 has a first connecting terminal 31 and a second connecting terminal 32. The first connecting terminal 31 is connected to a USB charging port 210 of the handheld device 20, and the second connecting terminal 32 is removably connected to the USB socket 12 of the electronic lock body 10 as an unlocking key. The outer casing of the second connecting terminal 32 can be taken as the doorknob portion for being rotated to unlock the electronic lock body.

As shown in FIGS. 1-5, the electronic lock body 10 may be charged through the USB charging port 210 by the USB connection cable 30 to power the main control board 15 and compare the inputted unlocking password. If the comparison result is correct, the electronic lock body 10 can be unlocked. Because the invention does not require a real key to unlock the electronic lock body, the problem arising from the lost key or rusty key can be eliminated.

Referring to FIGS. 1, 2, and 5-8, the method for using the smart electronic lock of the invention will now be illustrated as follows.

In Step S101, the electronic lock body 10 is mounted onto a target object.

In Step S102, an unlocking application 220 is downloaded to the handheld device 20. The user may register online using the unlocking application and log in with the unlocking application to set up an unlocking password.

In Step S103, the first connecting terminal 31 and the second connecting terminal 32 of the USB connection cable 30 are respectively connected to the handheld device 20 and the electronic lock body 10 for data transfer and power supply. The main power source 21 of the handheld device 20 is set to power the main control board 15 of the electronic lock body 10 through the USB charging port 210 by the USB connection cable 30.

In Step S104, the user inputs unlocking password 25 to the handheld device 20 through the unlocking application 220. The inputted unlocking password 25 is transferred to the password comparing unit 152 of the electronic lock body 10 by the USB cable 30 for comparison.

In step S105, if the comparison result is correct, the electronic lock cylinder 16 is enabled to release for unlocking the electronic lock body 10.

Figure 6:
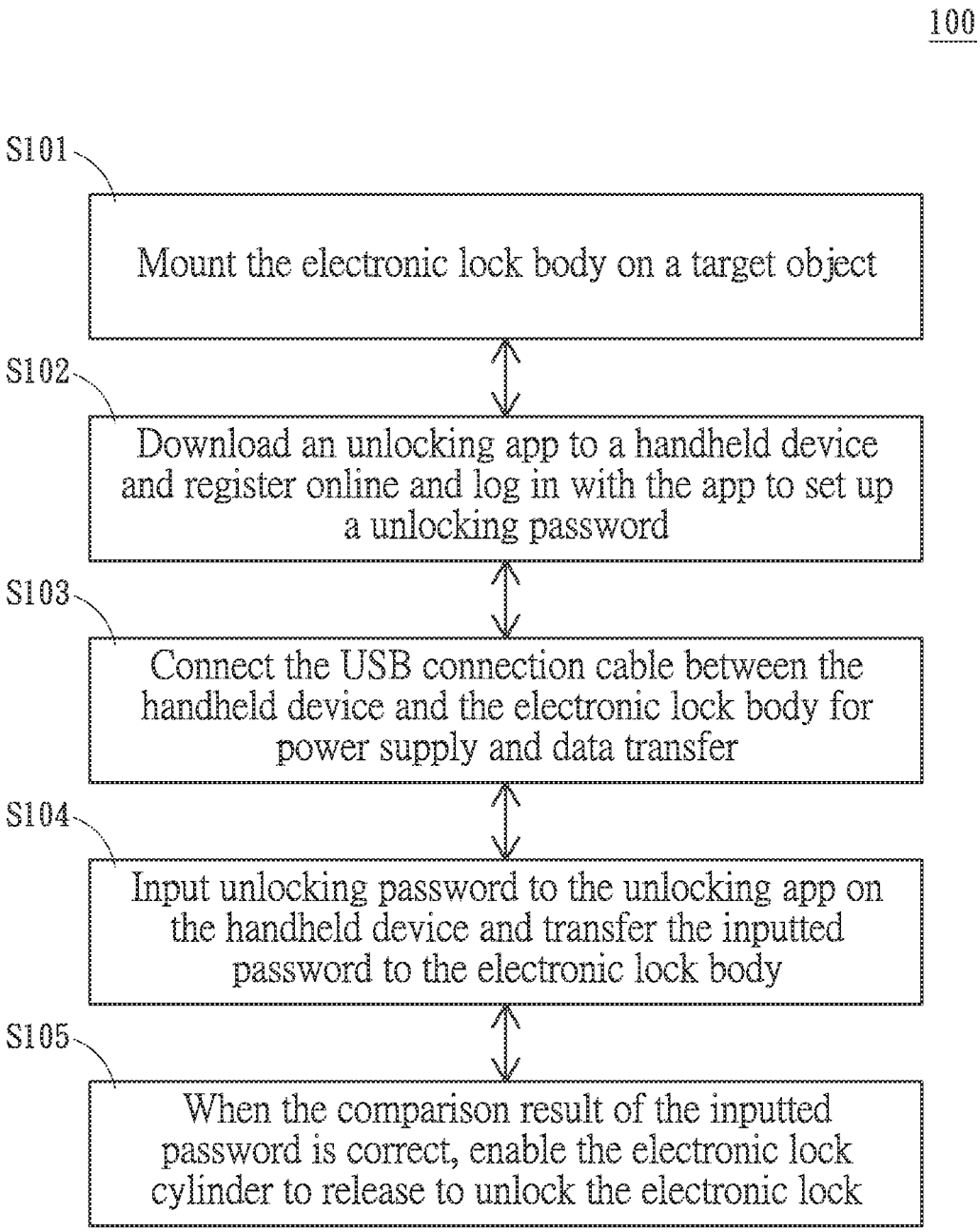
FIGS. 6 and 7 are flow chart diagrams showing the procedural step of a method for using the smart electronic lock according to the invention.

As shown in FIGS. 5 and 6, preferably the second connecting terminal 32 is connected to the USB socket 12 of the electronic lock body 10 as an unlocking key in step S103. In step S105, if the comparison result is correct and the electronic lock cylinder 16 is released, the outer casing of the second connecting terminal 32 is taken as the doorknob portion for being rotated to unlock the electronic lock body 10.

Figure 7:
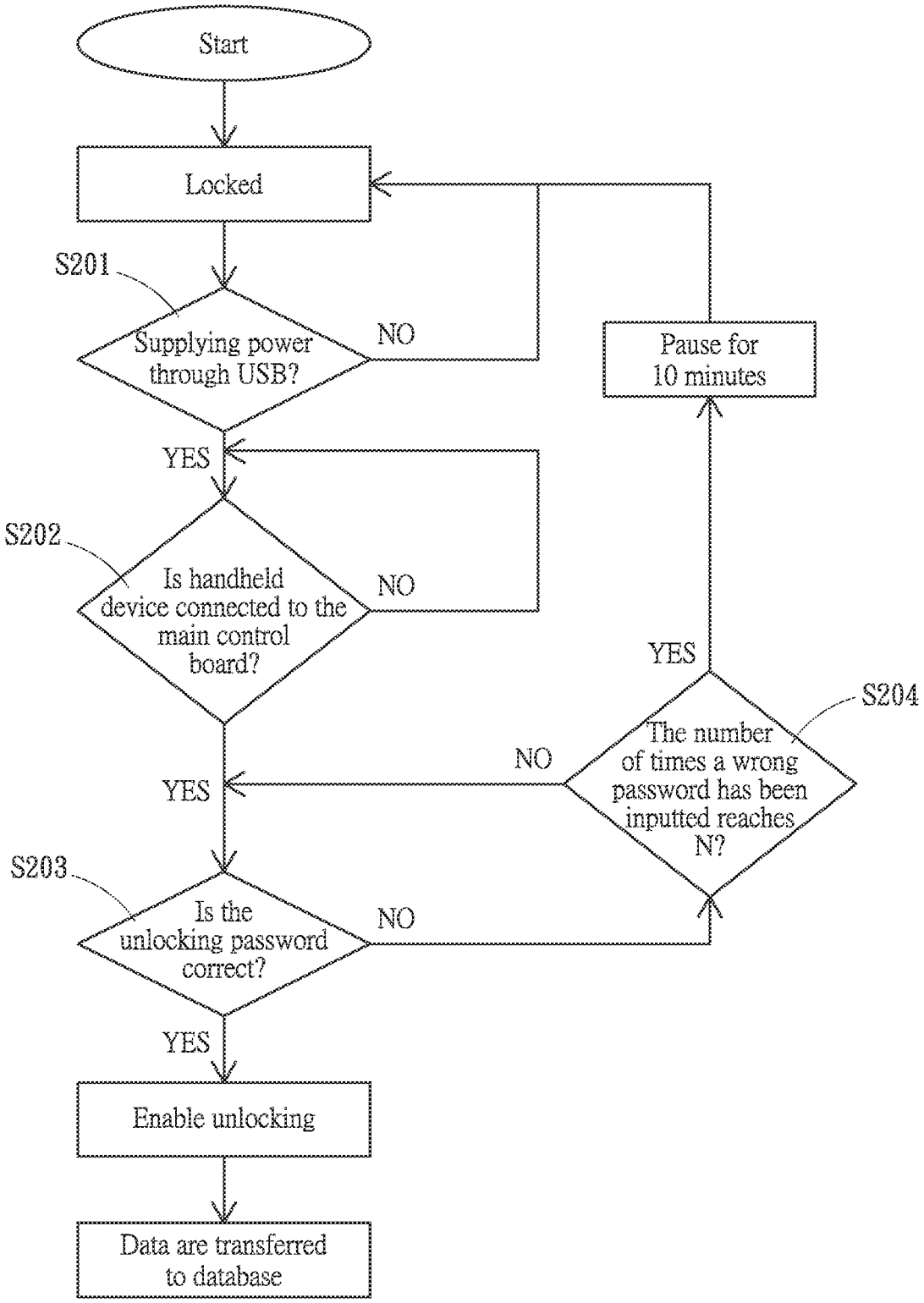

Please refer to FIG. 7, which illustrates the sub-steps belonging to the steps S103-S105 of FIG. 6. In step S201 it is determined whether the electronic lock body is supplied with power through the USB interface. If it is determined that the electronic lock body is not supplied with power through the USB interface, the electronic lock body will remain locked. If it is determined that the electronic lock body is supplied with power through the USB interface, the method continues with step S202 to determine whether the handheld device is connected to the main control board for data transmission. If it is determined that the handheld device is not connected to the main control board for data transmission, the method returns to execute step S202 again. If it is determined that the handheld device is connected to the main control board for data transmission, the method continues with step S203 to determine whether the unlocking password is correct. If it is determined that the unlocking password is correct, the method continues with the unlocking step. If it is determined that the unlocking password is wrong, the method continues with step S204 to determine whether the number of times a wrong password has been inputted reaches N, where N is a predetermined number. If it is determined that the number of times a wrong password has been inputted reaches N, the unlocking operation will be paused for 10 minutes and the electronic lock body 10 will return to the locked state. If it is determined that the number of times a wrong password has been inputted does not reach N, the method continues with step S203.

Preferably, when the step S203 of FIG. 7 is executed, that is, when the method carries out the step of determining whether the inputted unlocking password is correct, some data, including the identification number of the handheld device, the password information, the unlocking time, and the product number of the electronic lock body, may be transferred to a database (not shown) for helping in access control, access tracking record, and access right identification.

Figure 8:
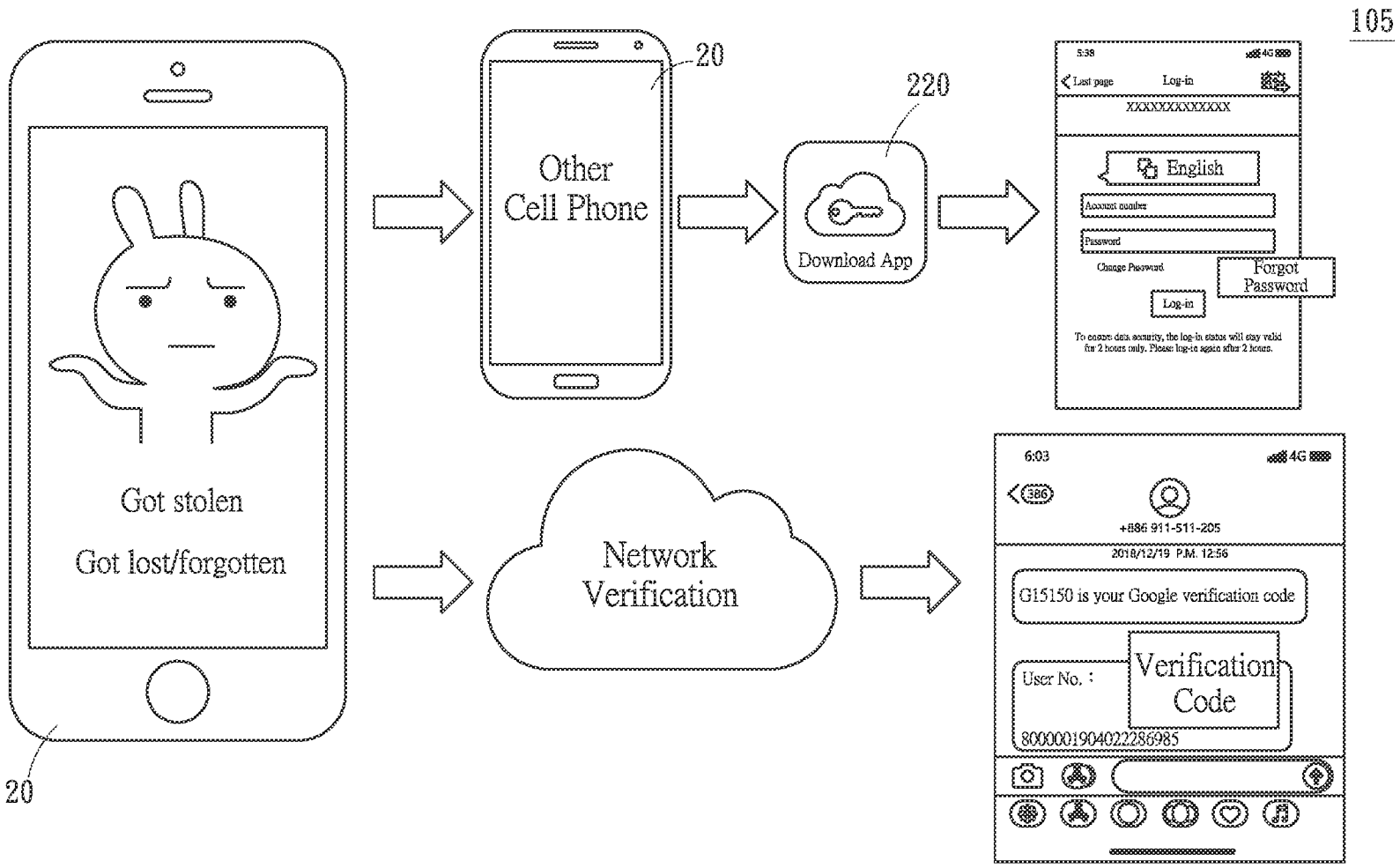
FIG. 8 is a schematic diagram showing the password recovery mechanism according to the invention.

As shown in FIG. 8, preferably the invention provides a password recovery mechanism 105 for allowing a user to recover the unlocking password 25 through a network verification process by the unlocking application 220 when the user lost his/her handheld device 20 or forgot the unlocking password 25.

Compared to the prior art, the invention has the following advantages:

1. The electronic lock body of the invention does not need an internal power source or a battery. The electronic lock body of the invention can be powered by a handheld device and unlocked by an unlocking application without the need of a real key. Hence, the problem arising from the lost key or rusty key can be eliminated.

2. The invention is helpful in access control and access right identification and access tracking record.

3. The electronic lock body of the invention can be used independently, or combined with traditional lock. The electronic lock body may be a cabinet lock, a drawer lock, a display case lock, a U-shaped lock, a suitcase lock, a briefcase lock, TSA-accepted luggage lock, a pin tumbler lock, a mailbox lock, a water meter/gas meter lock, a gateway lock, a door lock, a bathroom lock, a vehicle lock, a hotel room lock, a compartment lock, or a public restroom lock.

The above descriptions only disclose a preferred embodiment of the invention. However, it is to be understood that the invention should not be limited to the accurate form or the preferred embodiments disclosed herein. The preferred embodiments stated above cannot be taken to limit the scope of the invention. The invention should encompass various modifications and alterations made based on the foregoing embodiments. An artisan having ordinary skill in the art can understand the way to embody the foregoing embodiment, and the equivalent modifications which are made based on the claims are still within the scope of the invention.

What is claimed is:

1. A method for using a smart electronic lock including an electronic lock body, a handheld device, and a USB connection cable, comprising the steps of:

(a) mounting the electronic lock body on a target object;

(b) downloading an unlocking application to the handheld device and register online using the unlocking application and log in with the unlocking application to set up an unlocking password;

(c) connecting a first connecting terminal and a second connecting terminal of the USB connecting cable to a handheld device having a main power source and the electronic lock body respectively, wherein the electronic lock body includes a USB socket and a main control board, and the second connecting terminal of the USB connecting cable is removably connected to the USB socket of the electronic lock body and taken as an unlocking key, and the main power source of the handheld device supplies power to the main control board of the electronic lock body through the USB socket by the USB connection cable;

(d) using the handheld device to input an unlocking password and transferring inputted unlocking password to the electronic lock body for comparison; and (e) if a comparison result of the electronic lock body is correct, enabling an electronic lock cylinder of the electronic lock body to release and allowing an outer casing of the second connecting terminal of the USB connecting cable to be rotated to unlock the electronic lock body;

wherein the step (c) further includes the following steps:

(c-1) determining whether the main power source of the handheld device is supplying power to the main control board of the electronic lock body through the USB socket by the USB connection cable; and (c-2) if it is determined that the main power source of the handheld device is supplying power to the main control board of the electronic lock body through the USB socket by the USB connection cable, determining whether the handheld device is connected to the main control board of the electronic lock body for data transfer.

2. The method according to claim 1, wherein the smart electronic lock provides a password recovery mechanism for allowing a user to recover the unlocking password by a network verification process through the unlocking application when the user lost the handheld device or forgot the unlocking password.

3. The method according to claim 1, wherein the step (d) further includes the following steps:

(d-1) determining whether the inputted password is correct;

(d-2) if it is determined that the inputted password is incorrect, determining whether the number of times a wrong password has been inputted reaches N, where N is a predetermined number; and (d-3) if it is determined that the number of times a wrong password has been inputted reaches N, pausing unlocking operation for 10 minutes.

* * * * *